US011143999B2

(12) United States Patent
Akatsuka et al.

(10) Patent No.: US 11,143,999 B2
(45) Date of Patent: Oct. 12, 2021

(54) SHEET-CONVEYING DEVICE AND IMAGE-FORMING APPARATUS

(71) Applicant: CANON KABUSHIKI KAISHA, Tokyo (JP)

(72) Inventors: Junya Akatsuka, Fujisawa (JP); Masaki Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/529,646

(22) Filed: Aug. 1, 2019

(65) Prior Publication Data

US 2019/0354058 A1 Nov. 21, 2019

Related U.S. Application Data

(63) Continuation of application No. 15/442,313, filed on Feb. 24, 2017, now Pat. No. 10,416,603.

(30) Foreign Application Priority Data

Feb. 25, 2016 (JP) ..... 2016-033990

(51) Int. Cl.
*B65H 85/00* (2006.01)
*G03G 15/00* (2006.01)
*G03G 15/23* (2006.01)

(52) U.S. Cl.
CPC ..... *G03G 15/6529* (2013.01); *B65H 85/00* (2013.01); *G03G 15/234* (2013.01);
(Continued)

(58) Field of Classification Search
CPC ..... B65H 85/00; B65H 2301/33312; B65H 2404/15; B65H 2801/06; G03G 15/22;
(Continued)

(56) References Cited

U.S. PATENT DOCUMENTS

2009/0056484 A1 3/2009 Hanashima
2010/0192710 A9* 8/2010 Hanashima ..... B65H 1/14 74/55

FOREIGN PATENT DOCUMENTS

JP H08-239152 A 9/1996
JP 2007-091415 A 4/2007
(Continued)

OTHER PUBLICATIONS

Machine translation of JP2007-91415. (Year: 2007).*
Machine translation of JP2014-205572. (Year: 2014).*

*Primary Examiner* — Thomas A Morrison
(74) *Attorney, Agent, or Firm* — Canon U.S.A., Inc. I.P. Division

(57) ABSTRACT

An image-forming apparatus for forming an image on a sheet includes an image-forming unit that forms the image on the sheet, and a conveying unit that conveys the sheet on which the image is formed by the image-forming unit. The conveying unit includes a pair of first rollers that discharges the sheet to the outside of the image-forming apparatus and a pair of second rollers that conveys the sheet in a direction in which the sheet is discharged to the outside of the image-forming apparatus and that subsequently switches a conveyance direction of the sheet to an opposite direction to convey the sheet again to the image-forming unit. The pair of the first rollers and the pair of the second rollers partially overlap when viewed in a width direction of the sheet that is perpendicular to the conveyance direction of the sheet.

6 Claims, 7 Drawing Sheets

(52) U.S. Cl.
CPC ..... *B65H 2301/33312* (2013.01); *B65H 2404/15* (2013.01); *B65H 2801/06* (2013.01); *G03G 2215/00586* (2013.01); *G03G 2215/0132* (2013.01)

(58) Field of Classification Search
CPC ..... G03G 15/231; G03G 15/234; G03G 15/6529; G03G 2215/00586; G03G 2215/0132
See application file for complete search history.

(56) References Cited

FOREIGN PATENT DOCUMENTS

| | | | | |
|---|---|---|---|---|
| JP | 5262858 | B2 | | 8/2013 |
| JP | 2014-205572 | | * | 10/2014 |

* cited by examiner

SHEET-CONVEYING DEVICE AND IMAGE-FORMING APPARATUS

CROSS-REFERENCE TO RELATED APPLICATIONS

This application is a continuation of U.S. patent application Ser. No. 15/442,313, filed on Feb. 24, 2017, which claims the benefit of Japanese Patent Application No. 2016-033990, filed Feb. 25, 2016, all of which are hereby incorporated by reference herein in their entireties.

BACKGROUND OF THE INVENTION

Field of the Invention

The present embodiments relate to a sheet-conveying device disposed in an image-forming apparatus that forms an image on a sheet.

Description of the Related Art

In an image-forming apparatus, sheets are supplied to an image-forming unit one by one from a sheet tray onto which a stack of the sheets are loaded, the image-forming unit forms an image on each sheet on the basis of inputted image signals, and the sheet is subsequently discharged to the outside of the image-forming apparatus. Among such image-forming apparatuses, there is an image-forming apparatus that enables duplex image forming (duplex printing) in a manner in which, after an image is formed on one surface (first surface) of a sheet, the sheet is inverted by an inverting portion and conveyed again to the image-forming unit, and an image is formed on the opposite surface (second surface) of the sheet.

Some types of inverting portions of image-forming apparatuses that enable duplex image forming include reverse rollers that can rotate in a forward direction and a reverse direction and that temporarily discharges a sheet to the outside of the image-forming apparatuses and switch the rotation direction of the reverse rollers back and forth between the forward direction and the reverse direction so as to invert the sheet. When the sheet is inverted in such a switching-back-type inverting portion, part of the sheet is first discharged to a discharge tray with the reverse rollers holding the rear end of the sheet in a conveyance direction.

The rotation direction of the reverse rollers is subsequently switched to the direction opposite to a discharge direction such that the rear end in the conveyance direction becomes the leading end, and the sheet is thereby fed to a duplex conveyance path for printing of the second surface. After an image is formed on the second surface, the sheet is finally discharged to the discharge tray from a discharge portion by using discharge rollers. Thus, the image-forming apparatuses typically include the discharge portion that discharges the sheet and the inverting portion that inverts the sheet as separated components in order to improve productivity in printing, as disclosed in Japanese Patent Laid-Open No. 2004-302182.

In the case where a pair of the discharge rollers disposed downstream of a fixing device is located close to a pair of the reverse rollers for duplex printing, there are problems of a complicated conveyance path and a large size of the apparatus.

SUMMARY OF THE INVENTION

According to various embodiments, an image-forming apparatus for forming an image on a sheet includes an image-forming unit that forms the image on the sheet, and a conveying unit that conveys the sheet on which the image is formed by the image-forming unit. The conveying unit includes a pair of first rollers that discharges the sheet to an outside of the image-forming apparatus and a pair of second rollers that conveys the sheet in a direction in which the sheet is discharged to the outside of the image-forming apparatus and that subsequently switches a conveyance direction of the sheet to the opposite direction to convey the sheet again to the image-forming unit. The pair of the first rollers and the pair of the second rollers partially overlap when viewed in a width direction of the sheet that is perpendicular to the conveyance direction of the sheet.

Further features of the various embodiments will become apparent from the following description of exemplary embodiments with reference to the attached drawings.

DESCRIPTION OF THE EMBODIMENTS

A sheet-conveying device according to an embodiment according to an aspect of the present disclosure and an image-forming apparatus according to the embodiment that includes the sheet-conveying device will be described in detail with reference to the drawings.

First Embodiment

Figure 1:
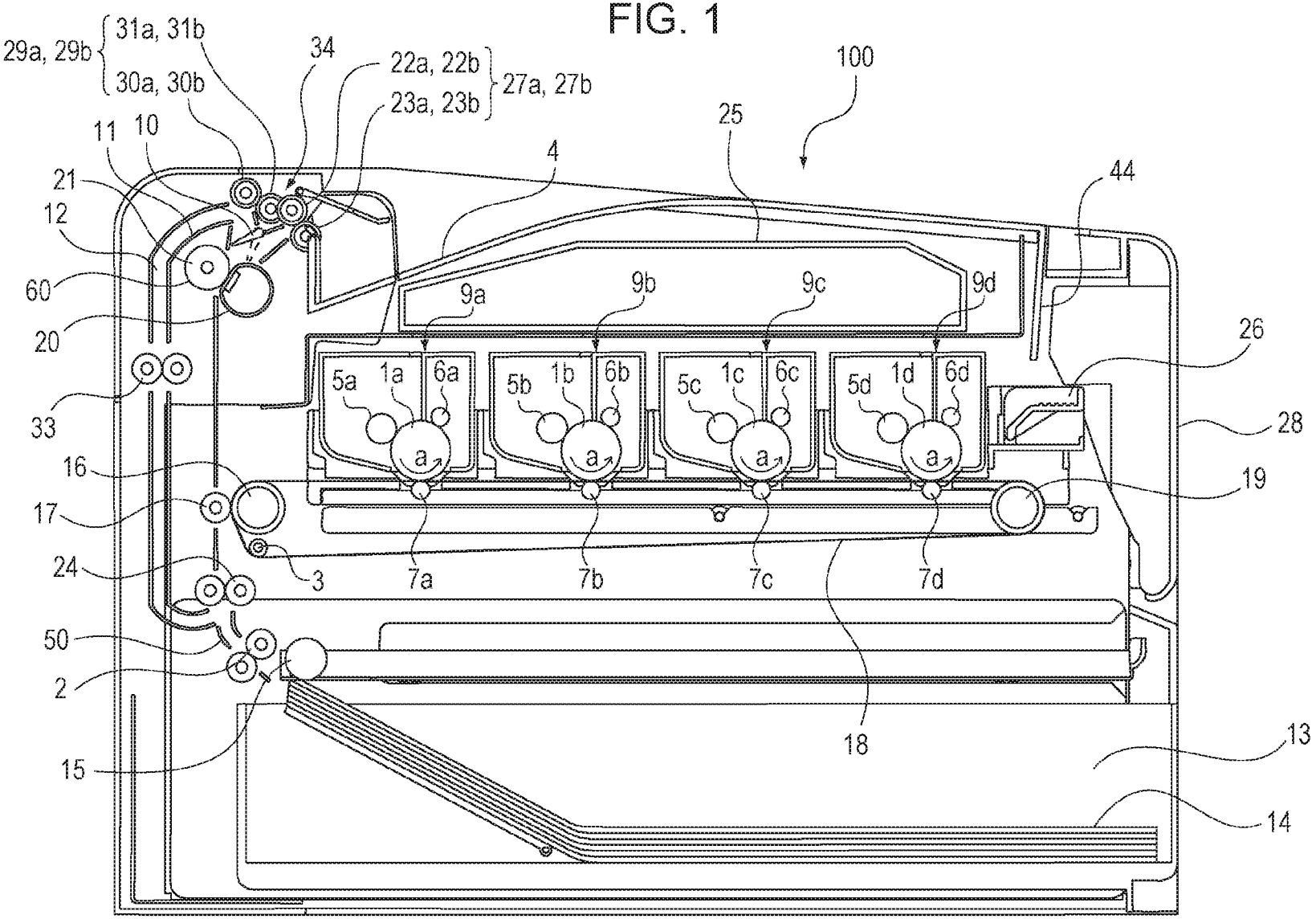
FIG. 1 is an explanatory diagram illustrating the sectional structure of a sheet-conveying device according to a first embodiment according to an aspect of the present disclosure and an image-forming apparatus according to the first embodiment that includes the sheet-conveying device.

The structure of the sheet-conveying device according to a first embodiment according to an aspect of the present disclosure and an image-forming apparatus according to the first embodiment that includes the sheet-conveying device will be described with reference to FIG. 1 to FIG. 4. An image-forming apparatus 100 illustrated in FIG. 1 is an example of application to a full color laser beam printer as an example of a color electrophotography image-forming apparatus. The image-forming apparatus 100 may be applied to any other image-forming apparatuses such as a color electrophotography copying machine and a facsimile machine in addition to a full color laser beam printer.

Image-Forming Apparatus

The structure of the image-forming apparatus 100 will now be described with reference to FIG. 1. FIG. 1 is an explanatory diagram illustrating the sectional structure of the image-forming apparatus 100 according to the embodiment. The main body of the image-forming apparatus 100 includes the components of the image-forming apparatus 100 other than process cartridges 9*a* to 9*d* for four colors of yellow, magenta, cyan, and black and a tray 26 that detachably supports the process cartridges 9*a* to 9*d*.

The process cartridges 9*a* to 9*d* have substantially the same structure except for using different toner colors. Accordingly, the process cartridges 9*a* to 9*d* are also referred to simply as the process cartridges 9. The same is true in the case of other image-forming process units. The process cartridges 9 are formed as toner-image-forming units that form a toner image on a sheet 14.

In the following description, the near side (front side of the main body) of the main body of the image-forming apparatus 100 corresponds to the side (right side in FIG. 1) on which a door 28 (opening-closing member) is disposed on the main body of the image-forming apparatus 100 so as to be openable and closeable. The door 28 closes such that an opening (opening portion) formed in the outer wall 44 of the main body of the image-forming apparatus 100 is openable. The tray 26 passes through the opening formed in the outer wall 44 when moving between a position on the inside and a position on the outside. The far side (rear side of the main body) of the main body of the image-forming apparatus 100 corresponds to the side (left side in FIG. 1) on which a conveyance path 50 for the sheet 14 is formed and the side opposite to the side on which the door 28 is formed.

A sheet cassette 13 that is loaded with the sheets 14 as recording material is disposed in the main body of the image-forming apparatus 100. A supply roller 15 and an intermediate transfer belt 18 are also disposed therein. A fixing film 20 and a pressure roller 21 included in a fixing device 60, which is a fixing unit, are also disposed therein. A laser scanner 25, which is an image-developing unit, is also disposed therein. The tray 26 is also disposed therein so as to be movable between a position on the inside and a position on the outside with respect to the main body of the image-forming apparatus 100.

The tray 26 detachably supports the process cartridges 9. Photosensitive drums 1, developing rollers 5, and charge rollers 6 are integrally disposed in the respective process cartridges 9. The photosensitive drums 1 are image-bearing members and are each formed of a drum-shaped electrophotographic photosensitive member. The developing rollers 5 are developing units as image-forming process units that act on the corresponding photosensitive drums 1. The charge rollers 6 are charge units. The process cartridges 9 are supported so as to be detachable from the tray 26 and each installed in the main body of the image-forming apparatus 100 at the position at which an image is formed.

The sheets 14 loaded in the sheet cassette 13 are fed and supplied separately one by one by the supply roller 15 that rotates clockwise in FIG. 1 in cooperation with a separation unit not illustrated. Each sheet 14 is conveyed by conveyance rollers 2 while being interposed therebetween, the leading end of the sheet 14 hits against a nip portion of registration rollers 24 that temporarily stop, and oblique motion of the sheet 14 is corrected due to the strength of the sheet 14 itself.

The sheet 14 is subsequently conveyed by the registration rollers 24 while being interposed therebetween with a predetermined timing and sent to a nip portion (secondary transfer portion) between the outer circumferential surface of the intermediate transfer belt 18 and a secondary transfer roller 17, which is a secondary transfer unit. The intermediate transfer belt 18 is stretched by a drive roller 16 and tension rollers 3 and 19 and rotates clockwise in FIG. 1. Primary transfer rollers 7*a* to 7*d*, which are primary transfer units, are disposed on the inner circumferential surface of the intermediate transfer belt 18 so as to face the corresponding photosensitive drums 1*a* to 1*d*.

When each photosensitive drum 1 starts to rotate in the direction of an arrow a in FIG. 1, the surface of the photosensitive drum 1 is uniformly charged by the corresponding charge roller 6. The uniformly charged surface of the photosensitive drum 1 is irradiated with a laser beam emitted from the laser scanner 25 in accordance with image information. Thus, an electrostatic latent image in accordance with the image information is formed sequentially on the surface of each photosensitive drum 1. The electrostatic latent image formed on the surface of the photosensitive drum 1 is supplied with a developer by the corresponding developing roller 5. Thus, the electrostatic latent image formed on the surface of the photosensitive drum 1 is developed as a toner image.

The process cartridges 9 contain developers of different colors but have substantially the same structure. The process cartridge 9*a* according to the embodiment contains a yellow developer and forms a yellow toner image (developer image) on the surface of the photosensitive drum 1*a*. The process cartridge 9*b* contains a magenta developer and forms a magenta toner image (developer image) on the surface of the photosensitive drum 1*b*. The process cartridge 9*c* contains a cyan developer and forms a cyan toner image (developer image) on the surface of the photosensitive drum 1*c*. The process cartridge 9*d* contains a black developer and forms a black toner image (developer image) on the surface of the photosensitive drum 1*d*.

The toner image formed on the surface of each photosensitive drum 1 is primarily transferred to the outer circumferential surface of the intermediate transfer belt 18. In the case where a color image is formed, the yellow, magenta, cyan, and black toner images formed on the surfaces of the photosensitive drums 1 are sequentially stacked on the outer circumferential surface of the intermediate transfer belt 18 and primarily transferred.

The intermediate transfer belt 18 is formed of an endless belt that rotates clockwise in FIG. 1 while being in contact with the surfaces of the photosensitive drums 1 and is rotatably stretched by the drive roller 16 and the tension rollers 3 and 19. The superposed toner image of the above colors that is primarily transferred to the outer circumferential surface of the intermediate transfer belt 18 is secondarily transferred to the sheet 14 conveyed to the secondary transfer portion formed of the nip portion between the outer circumferential surface of the intermediate transfer belt 18 wound around the outer circumferential surface of the drive roller 16 and the secondary transfer roller 17. The structure for forming the toner image (image) on the sheet 14 as described above corresponds to the image-forming unit.

The sheet 14 to which the toner image on the outer circumferential surface of the intermediate transfer belt 18 is secondarily transferred is as follows. The sheet 14 is conveyed to a fixing portion formed of a nip portion between the fixing film 20 and the pressure roller 21 that are included in the fixing device 60, which is the fixing unit that fixes the toner image formed by the toner-image-forming units on the sheet 14 by heating. At the fixing portion, the toner image is fixed on the sheet 14 by heating in a manner in which the toner image is melted by being heated and pressed when the sheet 14 is conveyed by the fixing film 20 and the pressure roller 21 while being interposed therebetween. Thus, a color image is formed on the sheet 14. In the case where a black image as a monochrome (single color) image is formed on the sheet 14, only a black toner image is formed on the surface of the photosensitive drum 1*d* and transferred to the sheet 14 in the above manner.

Sheet-Conveying Device

Figure 2:
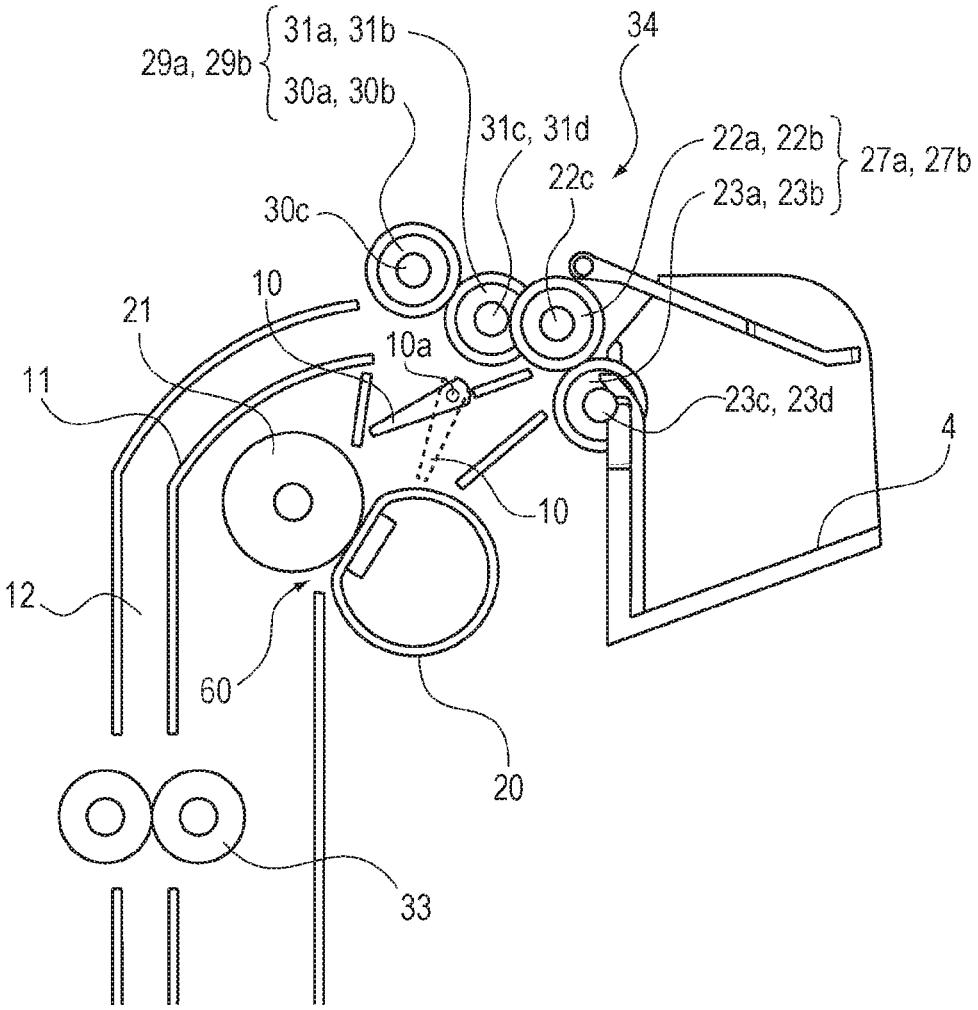
FIG. 2 is an explanatory diagram illustrating the sectional structure of the sheet-conveying device according to the first embodiment according to an aspect of the present disclosure.
Figure 3:
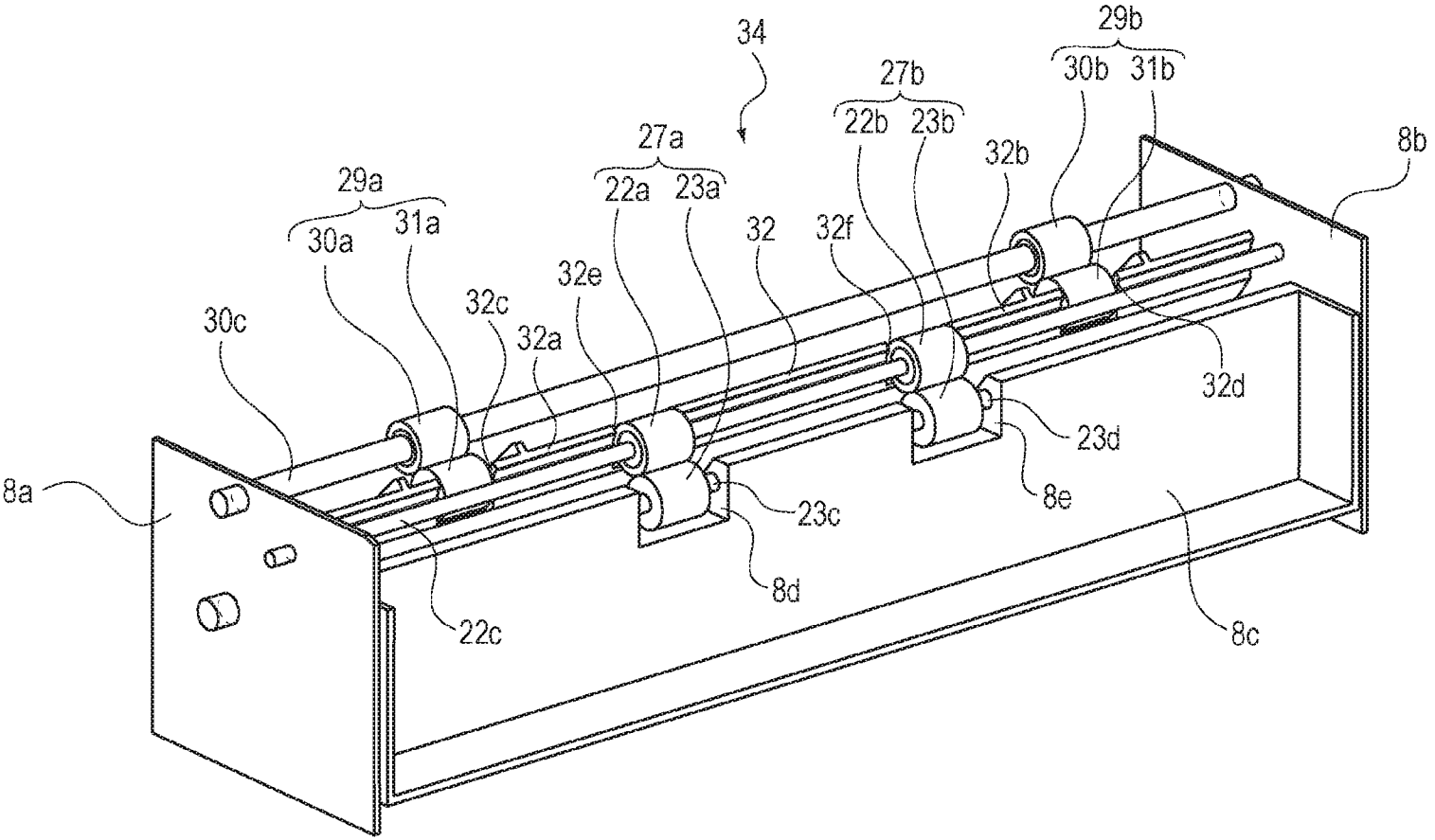
FIG. 3 is an explanatory diagram illustrating the structure of the sheet-conveying device according to the first embodiment viewed obliquely.
Figure 4:
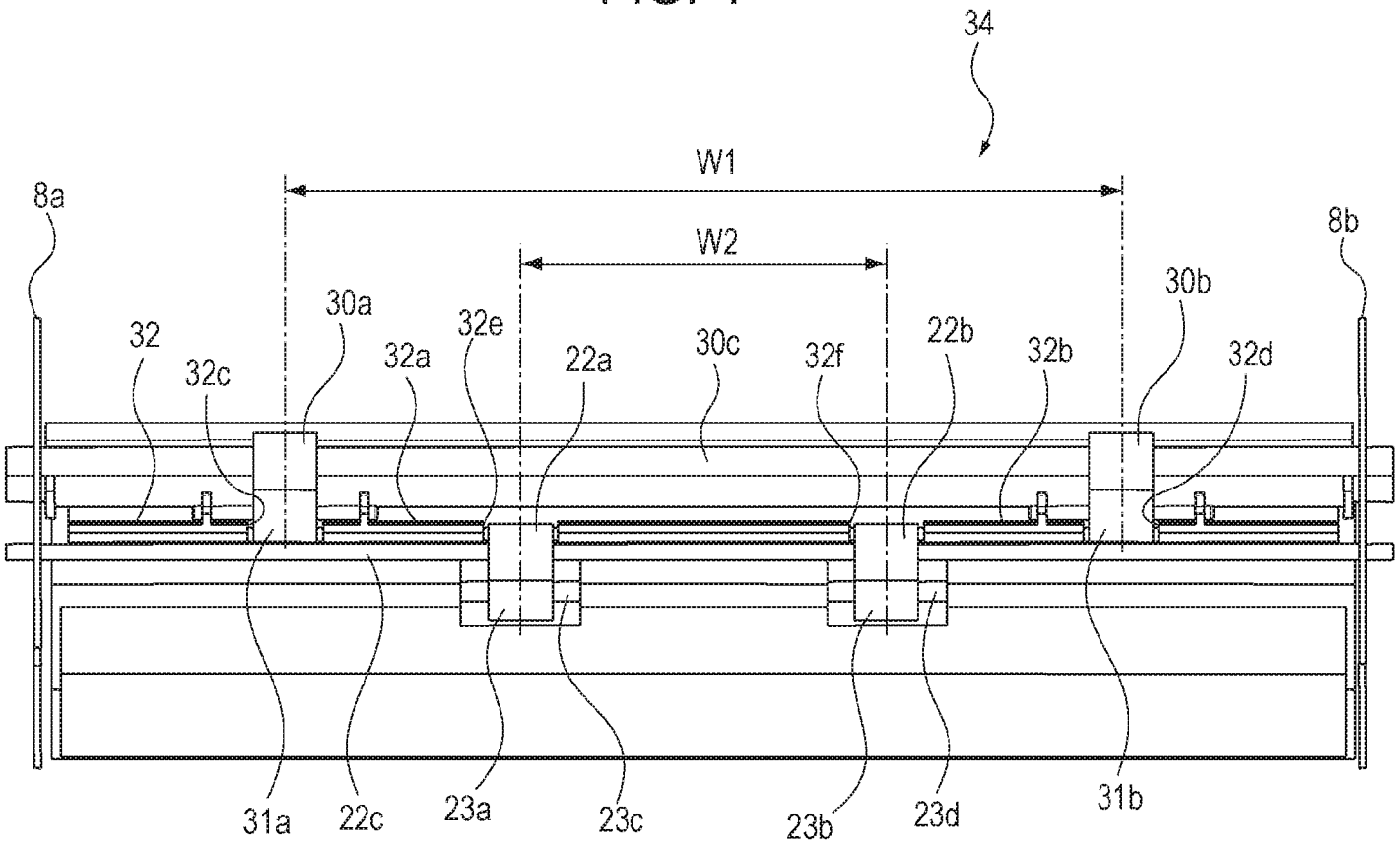
FIG. 4 is an explanatory diagram illustrating the structure of the sheet-conveying device according to the first embodiment viewed from the front.

The structure of the sheet-conveying device according to the embodiment will now be described with reference to FIG. 2 to FIG. 4. FIG. 2 is an explanatory diagram illustrating the sectional structure of the sheet-conveying device according to the embodiment. FIG. 3 is an explanatory diagram illustrating the structure of the sheet-conveying device according to the embodiment viewed obliquely. FIG. 4 is an explanatory diagram illustrating the structure of the sheet-conveying device according to the embodiment viewed from the front. The sheet 14 to which the toner image is fixed by heating by using the fixing device 60 illustrated in FIG. 2 is conveyed to a sheet-conveying device 34 illustrated in FIG. 2 to FIG. 4 while being interposed between the fixing film 20 and the pressure roller 21.

The sheet-conveying device 34 according to the embodiment includes two discharge rollers 22*a* and 22*b* that convey the sheet 14 and discharge the sheet 14 to a discharge tray 4 after the fixing film 20 and the pressure roller 21 convey the sheet 14 while interposing the sheet 14 therebetween. The sheet-conveying device 34 also includes discharge driven rollers 23*a* and 23*b* that are pressed against the corresponding discharge rollers 22*a* and 22*b* by using urging units not illustrated.

The discharge roller 22*a* (first drive roller) and the discharge driven roller 23*a* (first driven roller) form a pair of discharge rotators 27*a* corresponding to a pair of first rotators (a pair of first rollers). The discharge roller 22*b* (first drive roller) and the discharge driven roller 23*b* (first driven roller) form a pair of discharge rotators 27*b* corresponding to a pair of the first rotators (a pair of the first rollers). The discharge driven rollers 23*a* and 23*b* rotate with rotation of the discharge rollers 22*a* and 22*b*, respectively. The discharge rotators 27*a* and 27*b* discharge the sheet on which the toner image is formed to the outside of the image-forming apparatus 100. The sheet-conveying device 34 also includes a pair of reverse rotators 29*a* (pair of second rollers) formed of a reverse roller 30*a* (second drive roller) and a reverse driven roller 31*a* (second driven roller) and a pair of reverse rotators 29*b* (pair of the second rollers) formed of a reverse roller 30*b* (second drive roller) and a reverse driven roller 31*b* (second driven roller). The reverse rollers 30*a* and 30*b* convey the sheet 14 and invert the sheet 14 after the fixing film 20 and the pressure roller 21 convey the sheet 14 while interposing the sheet 14 therebetween. The reverse driven rollers 31*a* and 31*b* are pressed against the corresponding reverse rollers 30*a* and 30*b*. The reverse rotators 29*a* and 29*b* convey the sheet 14 on which the toner image is formed by the image-forming unit in the direction in which the sheet 14 is discharged to the outside of the image-forming apparatus 100 and subsequently switch the conveyance direction of the sheet 14 to the opposite direction to convey the sheet 14 again to the image-forming unit.

The discharge rotators 27*a* and 27*b* and the reverse rotators 29*a* and 29*b* are disposed downstream (upward in FIG. 2) of the fixing device 60 (fixing unit) in the conveyance direction of the sheet 14. A double-side flapper 10 is disposed downstream (upward in FIG. 2) of the fixing device 60 in the conveyance direction of the sheet 14 and upstream of the discharge rotators 27*a* and 27*b* and the reverse rotators 29*a* and 29*b* in the conveyance direction of the sheet 14. The double-side flapper 10 is a switching unit that switches the conveyance direction of the sheet 14 between a discharge path on which the discharge rotators 27*a* and 27*b* are disposed and a duplex conveyance path 12 on which the reverse rotators 29*a* and 29*b* are disposed.

The double-side flapper 10 is swung on a pivot 10*a* selectively between a position illustrated by a solid line in FIG. 2 and a position illustrated by a dashed line in FIG. 2 by using a solenoid, not illustrated, which is a driving unit. The discharge tray 4 forms a discharge portion that conveys the sheet 14 by using the discharge rotators 27*a* and 27*b* while interposing the sheet 14 therebetween and discharges the sheet 14. The duplex conveyance path 12 forms an inverting portion that conveys the sheet 14 by using the reverse rotators 29*a* and 29*b* while interposing the sheet 14 therebetween and inverts the sheet 14 after the fixing device 60 fixes the toner image on one surface of the sheet 14 in the case where the toner image is formed on both surfaces of the sheet 14.

The discharge rotators 27*a* and 27*b* convey the sheet 14 while interposing the sheet 14 therebetween and discharge the sheet 14 to the discharge tray 4 after the fixing film 20 and the pressure roller 21 that are included in the fixing device 60 convey the sheet 14 while interposing the sheet 14 therebetween. At this time, the double-side flapper 10 is swung on the pivot 10*a* upward to the position illustrated by the solid line in FIG. 2 and supported at the position.

In this case, the sheet 14 conveyed by the fixing film 20 and the pressure roller 21 while being interposed therebetween is as follows. The sheet 14 is guided by the double-side flapper 10 and reaches the nip portions between the discharge rollers 22*a* and 22*b* and the discharge driven rollers 23*a* and 23*b*, illustrated in FIG. 3, which form the discharge rotators 27*a* and 27*b*. The sheet 14 is conveyed by the discharge rollers 22*a* and 22*b* and the discharge driven rollers 23*a* and 23*b* while being interposed between the discharge roller 22*a* and the discharge driven roller 23*a* and between the discharge roller 22*b* and the discharge driven roller 23*b* and is discharged to the discharge tray 4.

In the case of printing on both surfaces of the sheet 14, the double-side flapper 10 is swung on the pivot 10*a* downward to the position illustrated by the dashed line in FIG. 2 and supported at the position. In this case, the sheet 14 conveyed by the fixing film 20 and the pressure roller 21 while being interposed therebetween is as follows. The sheet 14 is guided by the double-side flapper 10 and reaches the nip portions between the reverse rollers 30*a* and 30*b* and the reverse driven rollers 31*a* and 31*b*, illustrated in FIG. 3, which form the reverse rotators 29*a* and 29*b*.

The sheet 14 is conveyed by the reverse rollers 30*a* and 30*b* and the reverse driven rollers 31*a* and 31*b* while being interposed between the reverse roller 30*a* and the reverse driven roller 31*a* and between the reverse roller 30*b* and the reverse driven roller 31*b* until the rear end portion of the sheet 14 passes through the double-side flapper 10. The reverse rollers 30*a* and 30*b* subsequently rotate in the opposite direction, the rear end portion of the sheet 14 becomes the leading end, and the sheet 14 is conveyed into the duplex conveyance path 12. The duplex conveyance path 12 forming the inverting portion includes a conveyance guide 11 and conveyance rollers 33. The sheet 14 conveyed through the duplex conveyance path 12 while being guided by the conveyance guide 11 is conveyed by the conveyance rollers 33 while being interposed therebetween to the registration rollers 24 illustrated in FIG. 1 again. The second surface of the sheet 14 is printed in the same manner as the first surface.

After the second surface of the sheet 14 is printed, the double-side flapper 10 is swung on the pivot 10*a* upward to the position illustrated by the solid line in FIG. 2 and supported at the position. The sheet 14 is guided by the double-side flapper 10 and reaches the nip portions between the discharge rollers 22*a* and 22*b* and the discharge driven rollers 23*a* and 23*b*. The sheet 14 is conveyed by the discharge rollers 22*a* and 22*b* and the discharge driven rollers 23*a* and 23*b* while being interposed between the discharge roller 22*a* and the discharge driven roller 23*a* and between the discharge roller 22*b* and the discharge driven roller 23*b* and is discharged to the discharge tray 4 disposed at the upper portion of the main body of the image-forming apparatus 100.

As illustrated in FIG. 2, the discharge rotators 27*a* and 27*b* according to the embodiment is as follows. The discharge rotators 27*a* and 27*b* include the discharge rollers 22*a* and 22*b* that rotate by using a motor, not illustrated, which is a driving source, and the discharge driven rollers 23*a* and 23*b* that are respectively pressed against the discharge rollers 22*a* and 22*b* and caused to rotate. The reverse rotators 29*a* and 29*b* are as follows. The reverse rotators 29*a* and 29*b* include the reverse rollers 30*a* and 30*b* that rotate by using a motor, not illustrated, which is a driving source, and the reverse driven rollers 31*a* and 31*b* that are respectively pressed against the reverse rollers 30*a* and 30*b* and caused to rotate.

The discharge rollers 22*a* and 22*b* in the embodiment rotate about a rotating shaft 22*c* (first shaft) that is rotatably supported by a pair of side plates 8*a* and 8*b* illustrated in FIG. 3. The reverse rollers 30*a* and 30*b* rotate about a rotating shaft 30*c* that is rotatably supported by the side plates 8*a* and 8*b*.

The discharge driven rollers 23*a* and 23*b* are rotatable about rotating shafts 23*c* and 23*d* disposed between the side walls of notch portions 8*d* and 8*e* formed on a support plate 8*c* connected to the side plates 8*a* and 8*b*. The reverse driven rollers 31*a* and 31*b* are rotatable about rotating shafts 31*c* and 31*d* disposed between the side walls of notch portions 32*c* and 32*d* formed on a support plate 32 connected to the side plates 8*a* and 8*b*. Notch portions 32*e* and 32*f* are formed on the support plate 32 at positions corresponding to the discharge rollers 22*a* and 22*b* and accommodate the discharge rollers 22*a* and 22*b* such that the discharge rollers 22*a* and 22*b* are rotatable.

As illustrated in FIG. 3 and FIG. 4, the reverse rollers 30*a* and 30*b* and the reverse driven rollers 31*a* and 31*b* are arranged in the direction (referred to as the "width direction of the sheet 14") perpendicular to the conveyance direction of the sheet 14. Similarly, the discharge rollers 22*a* and 22*b* and the discharge driven rollers 23*a* and 23*b* are arranged in the width direction of the sheet 14 at different positions in the width direction of the sheet 14. As illustrated in FIG. 4, a distance W1 between the pair of the reverse roller 30*a* and the reverse driven roller 31*a* and the pair of the reverse roller 30*b* and the reverse driven roller 31*b* in the width direction of the sheet 14 is as follows. The distance W1 is larger than a distance W2 between the pair of the discharge roller 22*a* and the discharge driven roller 23*a* and the pair of the discharge roller 22*b* and the discharge driven roller 23*b* in the width direction of the sheet 14. That is, the discharge rotators 27*a* and 27*b* are arranged in the width direction of the sheet 14 at different positions in the width direction of the sheet 14 between the reverse rotators 29*a* and 29*b* arranged in the width direction of the sheet 14.

In this case, the discharge rotators 27*a* and 27*b* and the reverse rotators 29*a* and 29*b* are as follows. As illustrated in FIG. 4, the discharge rotators 27*a* and 27*b* and the reverse rotators 29*a* and 29*b* are disposed so as not to overlap in the direction of their rotating shafts (direction of the rotating shafts 22*c*, 23*c*, 23*d*, 30*c*, 31*c*, and 31*d*).

As illustrated in FIG. 2, the reverse driven rollers 31*a* and 31*b* are arranged so as to overlap the discharge rollers 22*a* and 22*b* in the radial direction when viewed in the direction of the rotating shafts of the discharge rollers 22*a* and 22*b*. Consider rotators that are located close to each other in the radial direction among the discharge rotators 27*a* and 27*b* and the reverse rotators 29*a* and 29*b*. Such rotators are the reverse driven rollers 31*a* and 31*b* and the discharge rollers 22*a* and 22*b*, which are arranged so as to overlap in the radial direction.

In the embodiment, as illustrated in FIG. 3 and FIG. 4, press members 32*a* and 32*b*, which are separation members, are disposed between the reverse driven roller 31*a* and the discharge roller 22*a* and between the reverse driven roller 31*b* and the discharge roller 22*b*. The press members 32*a* and 32*b* are parts of the support plate 32. The press members 32*a* and 32*b* are disposed in an area in which the reverse driven rollers 31*a* and 31*b* overlap the discharge rollers 22*a* and 22*b* in the radial direction. The press members 32*a* and 32*b* are stoppers that prevent contact between the outer circumferential surface of the reverse driven rollers 31*a* and 31*b* and the rotating shaft 22*c* of the discharge rollers 22*a* and 22*b*.

The press member 32*a*, which is the separation member, disposed between the notch portions 32*c* and 32*e* of the support plate 32 and the press member 32*b*, which is the separation member, disposed between the notch portions 32*d* and 32*f* achieve the following. Contact between the reverse driven rollers 31*a* and 31*b* and the discharge rollers 22*a* and 22*b* can be prevented.

The press members 32*a* and 32*b*, which are the separation members, are as follows. Consider rotators that are close to each other in the radial direction with the rotating shaft 22*c*, 23*c*, 23*d*, 30*c*, 31*c*, or 31*d* centering on the rotators among the discharge rotators 27*a* and 27*b* and the reverse rotators 29*a* and 29*b*. Such rotators are the discharge rollers 22*a* and 22*b* and the reverse driven rollers 31*a* and 31*b*, which are separated in the direction of the rotating shafts 22*c*, 31*c*, and 31*d* (rotating shaft direction).

In the embodiment, as illustrated in FIG. 2, the reverse rotators 29*a* and 29*b* including the reverse rollers 30*a* and 30*b* and the reverse driven rollers 31*a* and 31*b* are as follows. By way of example, the reverse rotators 29*a* and 29*b* are disposed on the side opposite to the discharge tray 4 with respect to the discharge rotators 27*a* and 27*b* including the discharge rollers 22*a* and 22*b* and the discharge driven rollers 23*a* and 23*b*.

In the embodiment, the discharge rollers 22*a* and 22*b* of the discharge rotators 27*a* and 27*b* disposed on the discharge portion and the reverse driven rollers 31*a* and 31*b* of the reverse rotators 29*a* and 29*b* disposed in the inverting portion are as follows. The discharge rollers 22*a* and 22*b* and the reverse driven rollers 31*a* and 31*b* are arranged at different positions in the direction of the rotating shafts 22*c*, 31*c*, and 31*d* so as to overlap in the radial direction with the rotating shafts 22*c*, 31*c*, and 31*d* centering on the corresponding rollers. This enables the size of the sheet-conveying device 34 to be decreased and enables the size of the image-forming apparatus 100 to be decreased.

Second Embodiment

Figure 5:
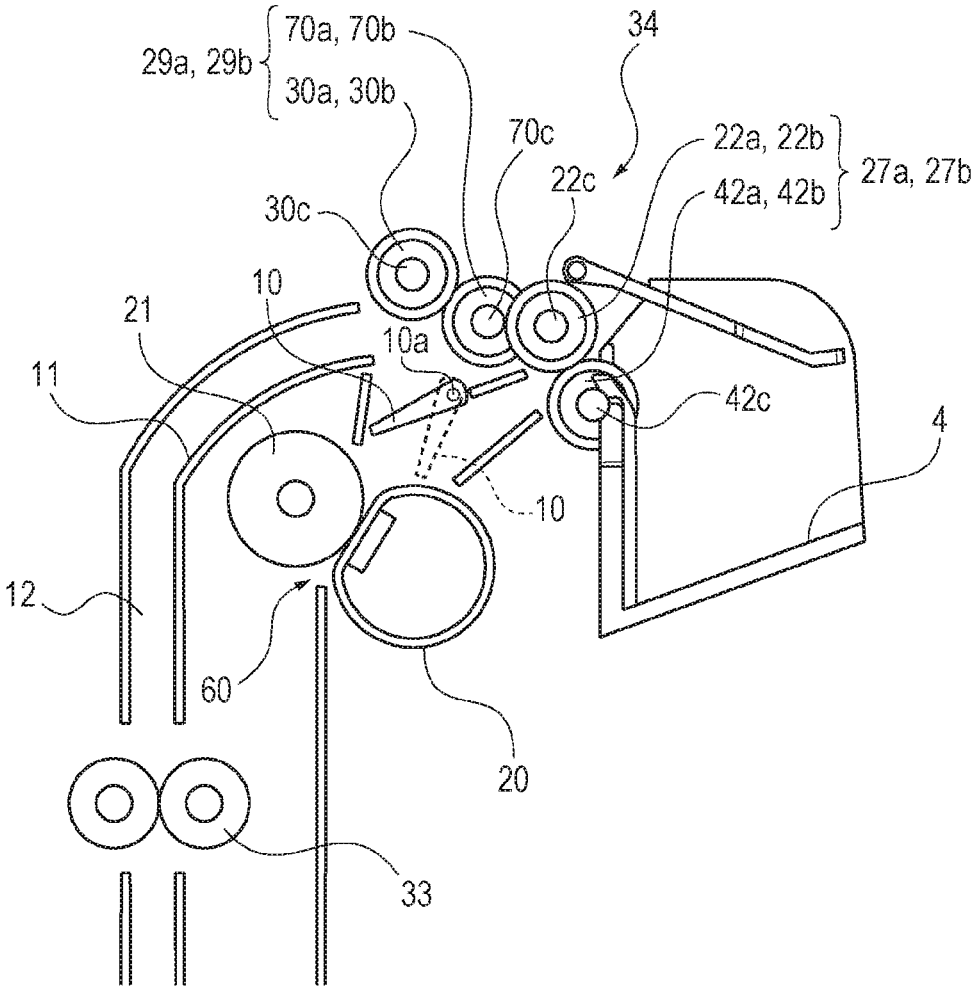
FIG. 5 is an explanatory diagram illustrating the sectional structure of a sheet-conveying device according to a second embodiment according to an aspect of the present disclosure.
Figure 6:
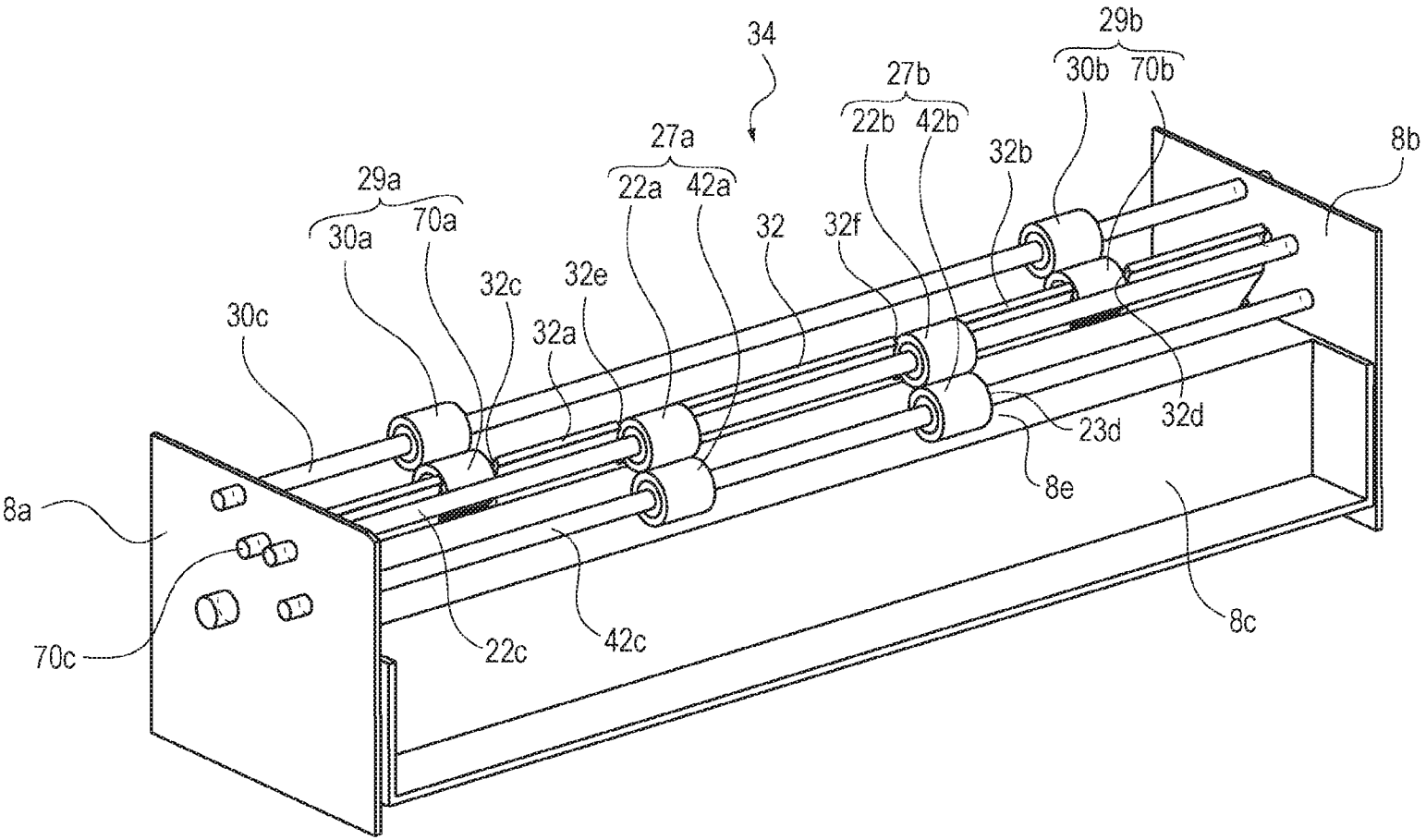
FIG. 6 is an explanatory diagram illustrating the structure of the sheet-conveying device according to the second embodiment viewed obliquely.
Figure 7:
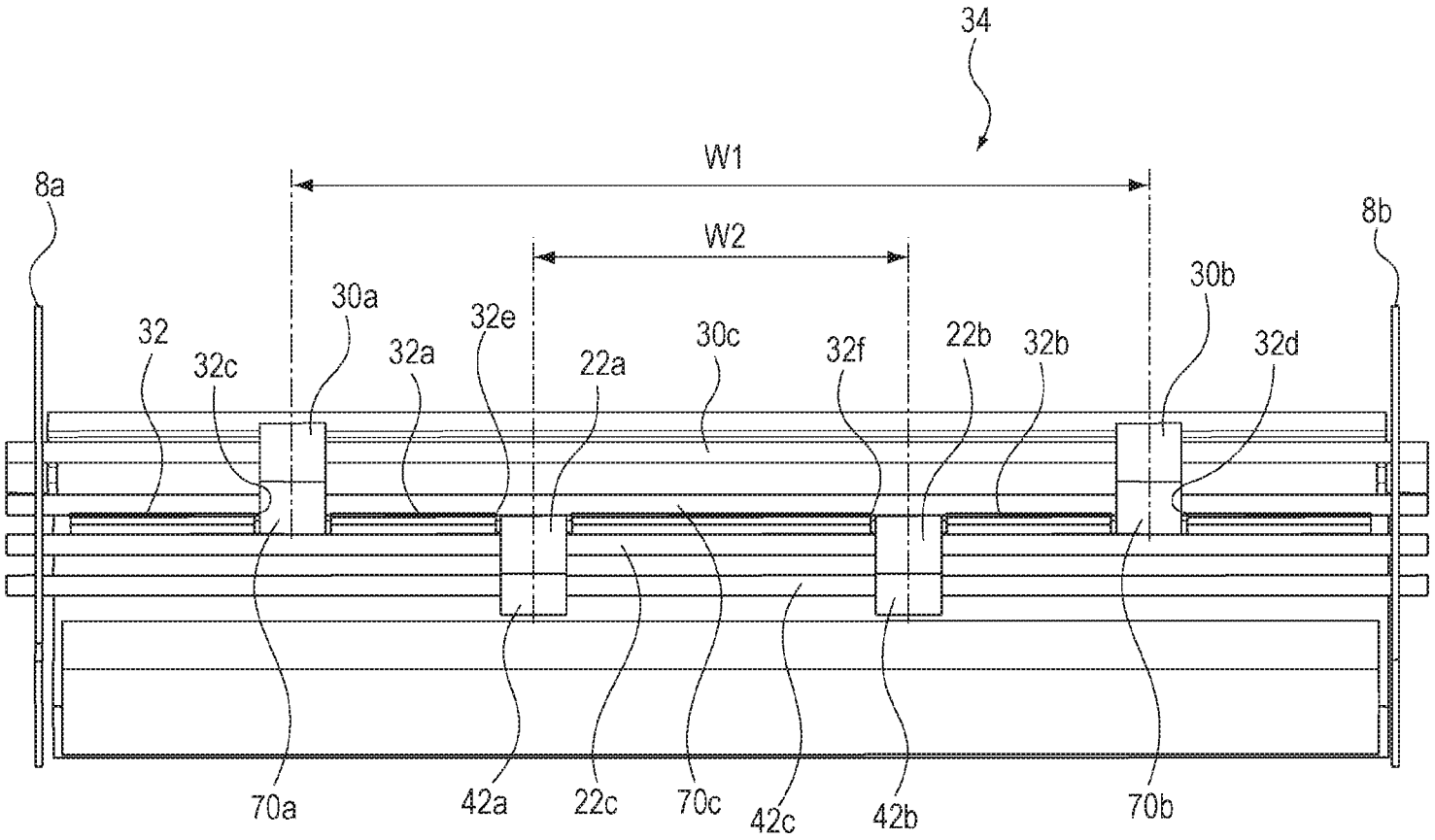
FIG. 7 is an explanatory diagram illustrating the structure of the sheet-conveying device according to the second embodiment viewed from the front.

The structure of a sheet-conveying device according to a second embodiment according to an aspect of the present disclosure and an image-forming apparatus according to the second embodiment will now be described with reference to FIG. 5 to FIG. 7. The same components as in the first embodiment are designated by like symbols or referred to as like names with different symbols, and a description thereof is omitted. FIG. 5 is an explanatory diagram illustrating the sectional structure of the sheet-conveying device according to the second embodiment according to an aspect of the present disclosure. FIG. 6 is an explanatory diagram illustrating the structure of the sheet-conveying device according to the second embodiment according to an aspect of the present disclosure viewed obliquely. FIG. 7 is an explanatory diagram illustrating the structure of the sheet-conveying device according to the second embodiment according to an aspect of the present disclosure viewed from the front.

In the first embodiment, the discharge rollers 22*a* and 22*b* and the reverse rollers 30*a* and 30*b* rotate when a rotational driving force is applied from a motor, not illustrated, which is a driving source. The discharge driven rollers 23*a* and 23*b* are respectively pressed against the discharge rollers 22*a* and 22*b* and caused to rotate. The reverse driven rollers 31*a* and 31*b* are respectively pressed against the reverse rollers 30*a* and 30*b* and caused to rotate.

In the second embodiment, a pair of the discharge rotators 27*a* (pair of the first rollers) corresponding to a pair of the first rotators is formed of the discharge roller 22*a* (first drive roller) and a discharge roller 42*a* (first driven roller), and a pair of the discharge rotators 27*b* (pair of the first rollers) corresponding to a pair of the first rotators is formed of the discharge roller 22*b* (first drive roller) and a discharge roller 42*b* (first driven roller). The discharge rollers 22*a* and 22*b* rotate by using a motor, not illustrated, which is a driving source. A pair of the reverse rotators 29*a* corresponding to a pair of second rotators is formed of the reverse roller 30*a* and a reverse roller 70*a*, and a pair of the reverse rotators 29*b* corresponding to a pair of the second rotators is formed of the reverse roller 30*b* and a reverse roller 70*b*. The reverse rollers 30*a*, 30*b*, 70*a*, and 70*b* rotate by using a motor, not illustrated, which is a driving source.

As illustrated in FIG. 7, a distance W1 between the pair of the reverse rollers 30*a* and 70*a* (second drive rollers) and the pair of the reverse rollers 30*b* and 70*b* (second drive rollers) in the width direction of the sheet 14 is as follows. The distance W1 is larger than a distance W2 between the pair of the discharge rollers 22*a* and 42*a* and the pair of the discharge rollers 22*b* and 42*b* in the width direction of the sheet 14. In this case, the discharge rotators 27*a* and 27*b* (two pairs of the first rotators or two pairs of the first rollers) and the reverse rotators 29*a* and 29*b* (two pairs of the second rotators or two pairs of the second rollers) are disposed so as not to overlap in the direction of their rotating shafts (direction of the rotating shafts 22*c*, 42*c*, 30*c*, and 70*c*).

As illustrated in FIG. 5, consider rotators that are located close to each other in the radial direction among the discharge rotators 27*a* and 27*b* and the reverse rotators 29*a* and 29*b*. Such rotators are the discharge rollers 22*a* and 22*b* and the reverse rollers 70*a* and 70*b*, which are arranged so as to overlap in the radial direction.

The discharge rollers 22*a* and 22*b* according to the second embodiment rotate about the rotating shaft 22*c* that is rotatably supported by a pair of the side plates 8*a* and 8*b* illustrated in FIG. 6. The discharge rollers 42*a* and 42*b* rotate about the rotating shaft 42*c* that is rotatably supported by the side plates 8*a* and 8*b*.

The reverse rollers 30*a* and 30*b* rotate about the rotating shaft 30*c* that is rotatably supported by the side plates 8*a* and 8*b*. The reverse rollers 70*a* and 70*b* rotate about the rotating shaft 70*c* that is rotatably supported by the side plates 8*a* and 8*b*. Notch portions 32*c* to 32*f* are formed on the support plate 32 connected to the side plates 8*a* and 8*b* at positions corresponding to the reverse rollers 70*a* and 70*b* and the discharge rollers 22*a* and 22*b* and accommodate the reverse rollers 70*a* and 70*b* and the discharge rollers 22*a* and 22*b* such that the reverse rollers 70*a* and 70*b* and the discharge rollers 22*a* and 22*b* are rotatable.

Consider rotators that are located close to each other in the radial direction among the discharge rotators 27*a* and 27*b* and the reverse rotators 29*a* and 29*b*. Such rotators are the discharge rollers 22*a* and 22*b* and the reverse rollers 70*a* and 70*b*, which are separated in the direction of their rotating shafts (direction of the rotating shafts 22*c* and 70*c*) by the press members 32*a* and 32*b*, which are the separation members. The press member 32*a* (separation member), which is disposed between the notch portions 32*c* and 32*e* of the support plate 32 and the press member 32*b* (separation member), which is disposed between the notch portions 32*d* and 32*f* achieve the following. Contact between the circumferential surface of the reverse rollers 70*a* and 70*b* and the rotating shaft 22*c* of the discharge rollers 22*a* and 22*b* can be prevented.

In the second embodiment, as illustrated in FIG. 5, the reverse rotators 29*a* and 29*b* including the reverse rollers 30*a*, 30*b*, 70*a*, and 70*b* are as follows. By way of example, the reverse rotators 29*a* and 29*b* are disposed on the side opposite to the discharge tray 4 with respect to the discharge rotators 27*a* and 27*b* including the discharge rollers 22*a*, 22*b*, 42*a*, and 42*b*.

In the second embodiment, consider the discharge rollers 22*a*, 22*b*, 42*a*, and 42*b* of the discharge rotators 27*a* and 27*b*, and the reverse rollers 30*a*, 30*b*, 70*a*, and 70*b* of the reverse rotators 29*a* and 29*b*. The discharge rotators 27*a* and 27*b* and the reverse rotators 29*a* and 29*b* are disposed at different positions in the direction of the rotating shafts 22*c*, 42*c*, 30*c*, and 70*c*.

The discharge rollers 22*a* and 22*b* and the reverse rollers 70*a* and 70*b* are arranged so as to overlap in the radial direction with the rotating shafts 22*c* and 70*c* centering on the corresponding rollers. This enables the size of the sheet-conveying device 34 to be decreased and enables the size of the image-forming apparatus 100 to be decreased. The other structure is the same as in the first embodiment, and the same effects can be achieved.

While aspects of the present disclosure have been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

What is claimed is:

1. An image-forming apparatus for forming an image on a sheet, the image-forming apparatus comprising:

an image-forming unit configured to form the image on the sheet;

a discharge unit configured to discharge the sheet to an outside of the image-forming apparatus, wherein the discharge unit includes a discharge roller, a discharge driving shaft configured to rotate by transmission of a discharge driving force and to support the discharge roller, a first driven roller configured to be driven to rotate with the discharge roller and a first supporting shaft that supports the first driven roller; and a conveyance unit configured to convey the sheet in an opposite direction to convey the sheet again to the image-forming unit, wherein the conveyance unit includes a conveyance roller, a conveyance driving shaft configured to rotate by transmission of a conveyance driving force and to support the conveyance roller, a second driven roller configured to be driven to rotate with the conveyance roller and a second supporting shaft that supports the second driven roller, wherein the discharge driving shaft and the conveyance driving shaft are disposed at different positions respectively when viewed in an axial direction of the discharge driving shaft, wherein the first supporting shaft and the second supporting shaft are disposed at respectively different positions when viewed in an axial direction of the first supporting shaft, wherein the discharge roller and the conveyance roller are arranged at different positons in a width direction of the sheet that is perpendicular to a conveyance direction of the sheet, wherein the discharge roller and the second driven roller partially overlap when viewed in the axial direction of the discharge driving shaft, wherein, in a height direction, the first supporting shaft is at the lowest position and the conveyance driving shaft is at the highest position, and wherein the discharge driving shaft and the second supporting shaft are located between the first supporting shaft and the conveyance driving shaft in the height direction.

2. The image-forming apparatus according to claim 1, further comprising a supporting portion that supports the discharge driving shaft and the conveyance driving shaft.

3. The image-forming apparatus according to claim 1, wherein the discharge roller is a first discharge roller and the discharge unit includes a second discharge roller supported by the discharge driving shaft.

4. The image-forming apparatus according to claim 3, wherein the discharge unit includes another first driven roller configured to be driven to rotate with the second discharge roller.

5. The image-forming apparatus according to claim 4, wherein the discharge unit includes another first supporting shaft that supports the other first driven roller and is coaxially located with the first supporting shaft.

6. The image-forming apparatus according to claim 5, wherein the first discharge roller and the second discharge roller are disposed between the conveyance roller and another conveyance roller in the width direction of the sheet.

* * * * *